US005125157A

United States Patent [19]

Howard

[11] Patent Number: 5,125,157

[45] Date of Patent: Jun. 30, 1992

[54] KNIFE WITH REMOVABLE IMPLEMENT

[76] Inventor: Durvyn M. Howard, Rte. 5, Box 77, Gadsden, Ala. 35903

[21] Appl. No.: 666,645

[22] Filed: Mar. 8, 1991

[51] Int. Cl.[5] ..... B26B 11/00; B26B 1/02; B26B 5/00; B26B 1/04

[52] U.S. Cl. ..... 30/123; 30/157; 30/161; 7/118

[58] Field of Search ..... 30/123, 138, 155, 157, 30/160, 161, 315, 340; 7/113, 118, 119, 120

[56] References Cited

U.S. PATENT DOCUMENTS

| | | | |
|---|---|---|---|
| 56,998 | 8/1866 | Sausser | 30/157 |
| 1,049,931 | 1/1913 | Smith | 30/157 |
| 1,087,342 | 2/1914 | Yerzley | 30/157 |
| 2,736,959 | 3/1956 | Simon et al. | 30/123 |
| 4,501,068 | 2/1985 | Palson | 30/157 |
| 4,570,341 | 2/1986 | Konneker | 7/118 |
| 4,769,912 | 9/1988 | Davis | 30/161 |

FOREIGN PATENT DOCUMENTS

| | | | |
|---|---|---|---|
| 775758 | 5/1957 | United Kingdom | 30/157 |

*Primary Examiner*—Douglas D. Watts
*Assistant Examiner*—Paul M. Heyrana, Sr.

[57] ABSTRACT

A handle of a knife is provided with a recess for receiving an implement, such as a tool or a toothpick. The recess is between the sideplates of the knife and above a locking bar spring. The implement has a hole for accepting a pin carried by a pivotally mounted arm. When the arm is in a first pivotal position, the pin is in engagement with the implement to hold the implement in the handle recess securely. When the arm is rotated, as by pressure exerted by a user's thumb, the arm is rotated and the pin is lifted from engagement with the implement to allow the implement to be withdrawn from the recess in the handle.

5 Claims, 1 Drawing Sheet

KNIFE WITH REMOVABLE IMPLEMENT

TECHNICAL FIELD

This invention relates to a folding knife and, in particular, to a folding knife having an additional implement removably held in the knife handle.

BACKGROUND OF THE INVENTION

Folding knives are known and generally include sideplates which provide a recess for the knife blade when in the folded position. The blade is typically pivotally attached to the side plates, and a blade lock is provided to hold the blade in the open position.

Knives having supplementary implements are also known. For example, U.S. Pat. No. 947,823 (Kinney) shows a knife capable of receiving a pencil holder. The frame of the Kinney knife is of folded metal, and the bight portion of the frame includes a slot for engaging the pencil holder in a sliding action. Other U.S. patents of interest are U.S. Pat. Nos. 171,997 (Crowles); 237,093 (Crowell); 682,892 (Thurston); 1,678,609 (Spanier); 1,712,405 (Sapo); 4,520,833 (Hadary); and 4,805,250 (Dugas).

SUMMARY OF THE INVENTION

In accordance with the invention, an implement is removably secured in a recess in a knife handle by a lock pin extending from a pivotally mounted arm. The lock pin engages an accepting recess in the implement when the implement is in the handle recess and the bar is in the locked position. When the bar is pivoted to a releasing position, the pin is withdrawn from the accepting recess, and the implement may be removed from the handle recess.

The implement may have an opening for receiving a thong, or the like, and which may be also used for grasping the implement to remove it from the handle recess when the locking mechanism is released. In a preferred embodiment, the implement is a toothpick, but it may be a variety of other implements, such as a field tool for a rifle, a screwdriver, or the like. The implement may be of any material, such as metal or plastic.

The arm which holds the implement in the handle recess is provided with tension to retain it in the locked position. This tension is preferably supplied by a secondary spring which extends between the locking arm and the main blade spring. The back of the knife is provided with recesses for allowing the locking arm to be pressed inward to the release position, and the secondary spring will return the locking bar to the locking position upon release of pressure.

DETAILED DESCRIPTION OF THE INVENTION

Figure 1:
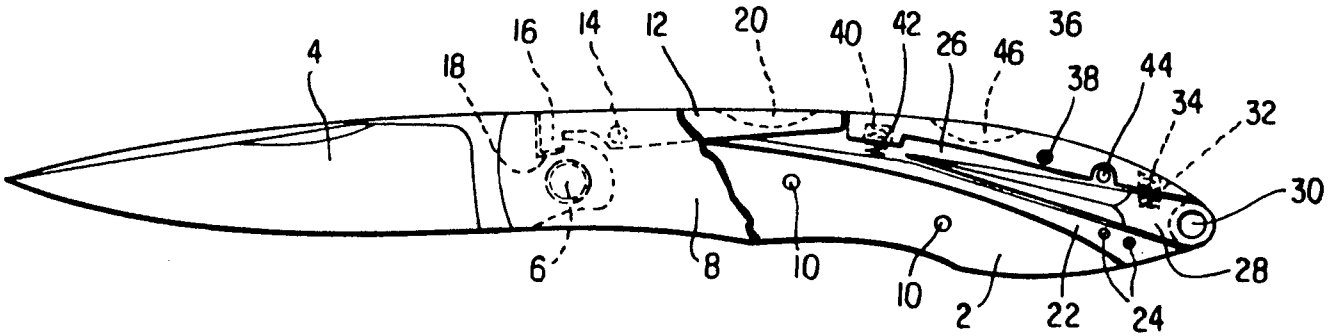
FIG. 1 is a side view in partial cross section of a knife in accordance with the invention.
Figure 3:
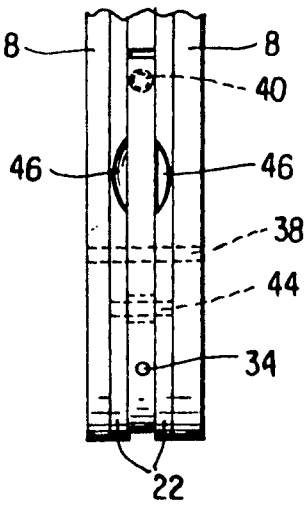
FIG. 3 is a partial top view of the knife shown in FIG. 3.
Figure 2:
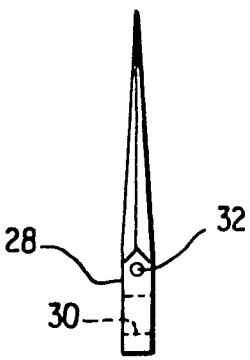
FIG. 2 is a top view of an implement in accordance with the invention.

With reference to the figures, a knife includes spaced sideplates 2 which pivotally mount a blade 4 by a pivot pin 6. Handles 8 (shown partially broken away in FIG. 1), which may contain decoration, are secured to the side plates by pins 10. A blade locking bar 12 is pivotally attached between the side plates at a pin 14. A lug 16 on the locking bar engages a notch 18 on the blade when the blade is in the open position to hold the blade in that position. When the locking bar is depressed, the lug is lifted from engagement with the notch to allow the blade to be folded. Recesses 20 are provided in the sideplates and handles, if necessary, to provide room for a user's thumb or finger to depress the blade locking bar 12 to release the blade.

A blade lock spring 22 is held between the side plates by pins 24. This spring is of flexible metal and extends along the handle to engage the blade locking bar 12 at a location to the rear of the pin 14 whereby the lug 16 is urged into engagement with the notch 18 when the blade is in the open position as shown in FIG. 1.

In accordance with an important aspect of the invention, a recess 26 is provided between the sideplates and above the locking bar spring for receiving an implement 28. The implement shown in the figures is a toothpick, but it may be designed to serve other functions as suggested above. The implement preferably includes an opening 30 for receiving, for example, a thong or chain.

An accepting hole 32 is formed in the implement 28 for being engaged by a pin 34 to secure the implement in the recess 26. Actually tapered pin press fit from beneath but may have a variety of constructions, and is held in an arm 36 which is pivotally mounted between the sideplates by a pin 38. A secondary spring 40 extends between one end of the arm 36 and the locking bar spring 22 to urge the arm 36 to rotate about the pin 38 thereby to urge the pin 34 into engagement with the hole 32 in the implement 28. The upper end of the secondary spring 40 is received in a recess 42 in the arm 36 to prevent movement of the secondary spring. Excessive movement of the arm 36 about the pin 38 as caused by the secondary spring 40 when the implement 28 has been withdrawn from the recess 26 is prevented by a stop pin 44.

Removal of the implement is accomplished by depression of the arm 36 at a location forward of the pivot 38, and this is facilitated by thumb recesses 46. When the forward part of the arm is depressed, the pin 34 is lifted from the engagement with the hole 32 which allows the implement to be withdrawn. As the implement is slid back into the recess, the pin will be urged upward against the force of the secondary spring until it falls into the hole 32, at which time the implement will be held securely in the hole 32.

Modifications within the scope of the appended claims will be apparent to those of skill in the art.

I claim:

1. A knife having a removable implement comprising spaced sideplates, a blade pivotally attached to said sideplates, said sideplates forming a recess for receiving said implement, and locking means for removably securing said implement in said recess, wherein said locking means comprises an arm pivotally attached to said side plates, said arm including engagement means for engaging said implement and retaining said implement in said recess when said arm is in a first pivotal position and not engaging said implement when said arm is in a second pivotal position, wherein said engagement means comprises a pin extending from said arm toward said recess and said implement includes a hole for accepting said pin.

2. A knife according to claim 1 further comprising means for resiliently urging said arm toward said first position.

3. A knife according to claim 2 wherein said resiliently urging means comprises a spring engaging said arm.

4. A knife according to claim 3 wherein said spring extends between a blade locking leaf spring and said arm.

5. A knife according to claim 3 further comprising stop means for preventing movement of said arm beyond a predetermined orientation when said implement has been removed from said handle recess.

* * * * *